US008810433B1

(12) United States Patent
Aarons

(10) Patent No.: US 8,810,433 B1
(45) **Date of Patent: *Aug. 19, 2014**

(54) GARAGE DOOR OPENER AND PARKING GUIDE COMBINATION

(76) Inventor: Ronald W. Aarons, Westlake Village, CA (US)

( * ) Notice: Subject to any disclaimer, the term of this patent is extended or adjusted under 35 U.S.C. 154(b) by 288 days.

This patent is subject to a terminal disclaimer.

(21) Appl. No.: 13/323,005

(22) Filed: Dec. 12, 2011

Related U.S. Application Data

(63) Continuation-in-part of application No. 12/145,685, filed on Jun. 25, 2008, now Pat. No. 8,077,054.

(51) Int. Cl.
*B60Q 1/48* (2006.01)

(52) U.S. Cl.
USPC ..... 340/932.2; 340/555; 340/556; 340/557; 340/5.71; 362/511; 116/28 R

(58) Field of Classification Search
USPC ..... 340/932.2, 555, 556, 557, 5.71, 942, 340/686.1; 116/28 R; 250/491.1; 362/511
See application file for complete search history.

(56) References Cited

U.S. PATENT DOCUMENTS

| | | | | |
|---|---|---|---|---|
| 3,869,569 | A * | 3/1975 | Mason et al. | 358/476 |
| 6,040,787 | A | 3/2000 | Durham | |
| 6,191,706 | B1 | 2/2001 | Kositkun | |
| D446,877 | S | 8/2001 | Lester | |
| 6,946,973 | B1 | 9/2005 | Yanda | |
| 6,989,760 | B2 | 1/2006 | Dierking et al. | |
| 7,102,296 | B1 * | 9/2006 | Munter et al. | 315/276 |
| 7,812,742 | B2 * | 10/2010 | Pankowski | 340/932.2 |
| 7,862,209 | B2 * | 1/2011 | Fitzgibbon et al. | 362/294 |
| 2002/0140576 | A1 | 10/2002 | Simon | |
| 2003/0160705 | A1 | 8/2003 | Guetz | |
| 2005/0253729 | A1 | 11/2005 | Su | |
| 2008/0231464 | A1 * | 9/2008 | Lewis et al. | 340/825 |
| 2009/0135595 | A1 * | 5/2009 | Chen | 362/235 |

* cited by examiner

*Primary Examiner* — Hung T. Nguyen

(57) ABSTRACT

A garage door opener and parking guide combination includes a male connector that is configured to be removably extended into and electrically coupled to a light bulb socket. A light bulb is electrically coupled to the male connector and emits light when electricity is supplied to the light bulb socket. The light bulb is non-removably coupled to the male connector. The male connector includes a first portion and a second portion. The first portion is threaded. The light bulb includes a plurality of light emitting diodes. A first electrical coupler is mounted in and non-removably affixed to the second portion of the male connector. The first electrical coupler is in electrical communication with the male connector. A laser light assembly is removably electrically coupled to the first electrical coupler and emits laser light when the male connector receives electricity from the light bulb socket.

12 Claims, 12 Drawing Sheets

GARAGE DOOR OPENER AND PARKING GUIDE COMBINATION

This application is a Continuation in Part of U.S. patent application Ser. No. 12/145,685 filed on Jul. 25, 2008, issued as U.S. Pat. No. 8,077,054, and I hereby claim the benefit of such under Title 35, United States Code, Section 120.

BACKGROUND OF THE DISCLOSURE

Field of the Disclosure

The present invention relates to parking guide devices and more particularly pertains to a new parking guide device for assisting a person in properly parking in their garage.

SUMMARY OF THE INVENTION

The present invention meets the needs presented above by generally comprising a male connector that is configured to be removably extended into and electrically coupled to a light bulb socket. A light bulb is electrically coupled to the male connector and emits light when electricity is supplied to the light bulb socket. The light bulb is non-removably coupled to the male connector. The male connector includes a first portion and a second portion. The first portion is threaded. The light bulb includes a plurality of light emitting diodes. A first electrical coupler is mounted in and non-removably affixed to the second portion of the male connector. The first electrical coupler is in electrical communication with the male connector. A laser light assembly is removably electrically coupled to the first electrical coupler and emits laser light when the male connector receives electricity from the light bulb socket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
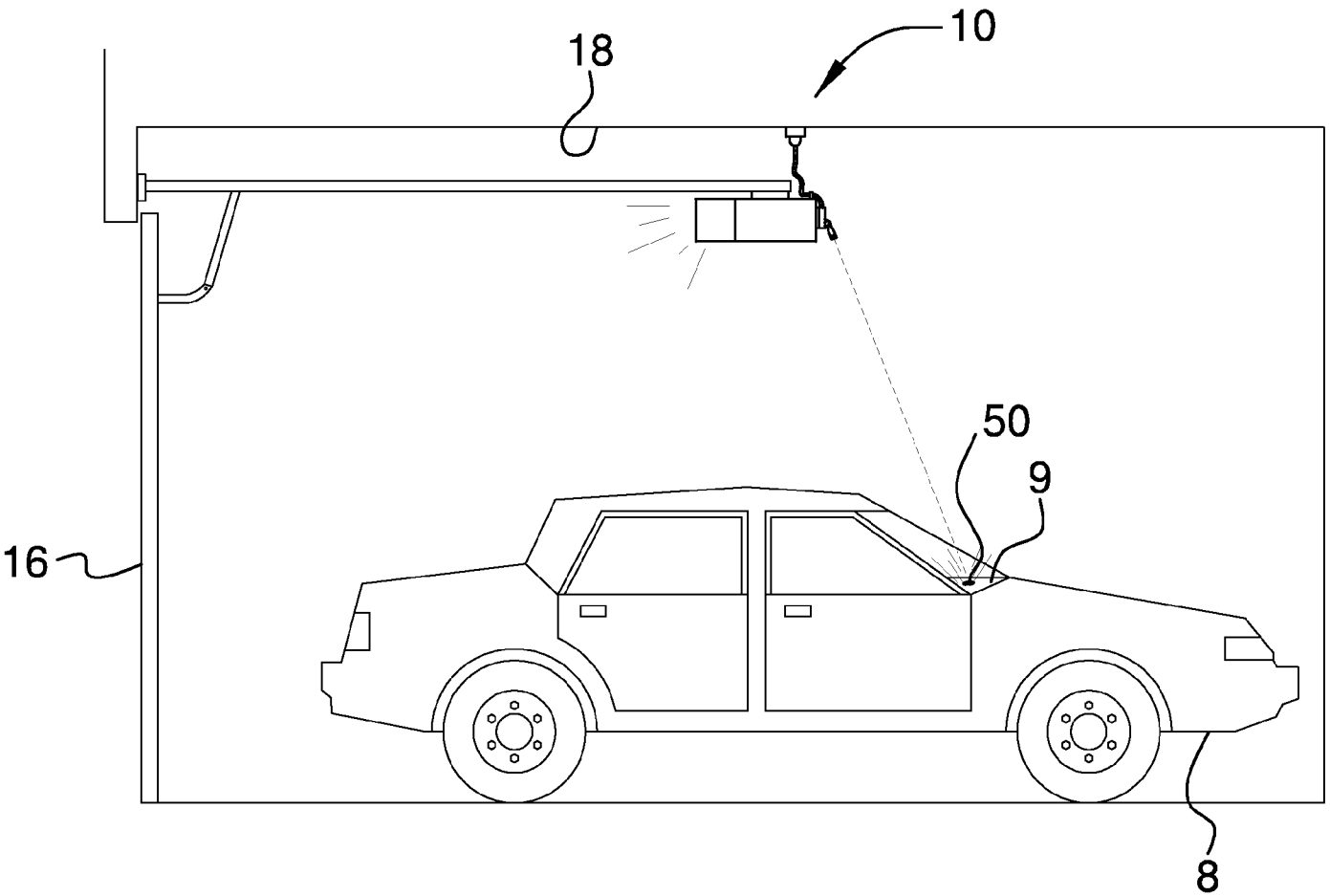
FIG. 1 is a side in-use view of a garage door opener and parking guide combination according to the present invention.

With reference now to the drawings, and in particular to FIGS. 1 through 14 thereof, a new parking guide device embodying the principles and concepts of the present invention and generally designated by the reference numeral 10 will be described.

As best illustrated in FIGS. 1 through 14, the garage door opener and parking guide combination 10 generally comprises a housing 12 that includes a drive assembly 14, which includes an electrical motor 15, mechanically coupled to a garage door 16 to selectively open or close the garage door 16 when the drive assembly 14 is activated. The housing 12 is attached to a ceiling 18 of a garage containing the garage door 16. A light bulb socket 20 is in electrical communication with a control 22 of the drive assembly 14 and receives electricity while the drive assembly 14 is activated. Typically, the light bulb socket 20 also receives electricity for a pre-selected time after the drive assembly 14 has been actuated to provide light for a person moving within the garage. A translucent covering 24 is removably attached to the housing 12 and positioned over the light bulb socket 20. The drive assembly 14 is remotely controlled and the entire housing 12, drive assembly 14 and light bulb socket 20 form a conventional garage door opening assembly.

A male connector 26 is removably extended in and electrically coupled to the light bulb socket 20. A light bulb 28 is electrically coupled to the male connector 26 and emits light when electricity is supplied to the light bulb socket 20.

Figure 2:
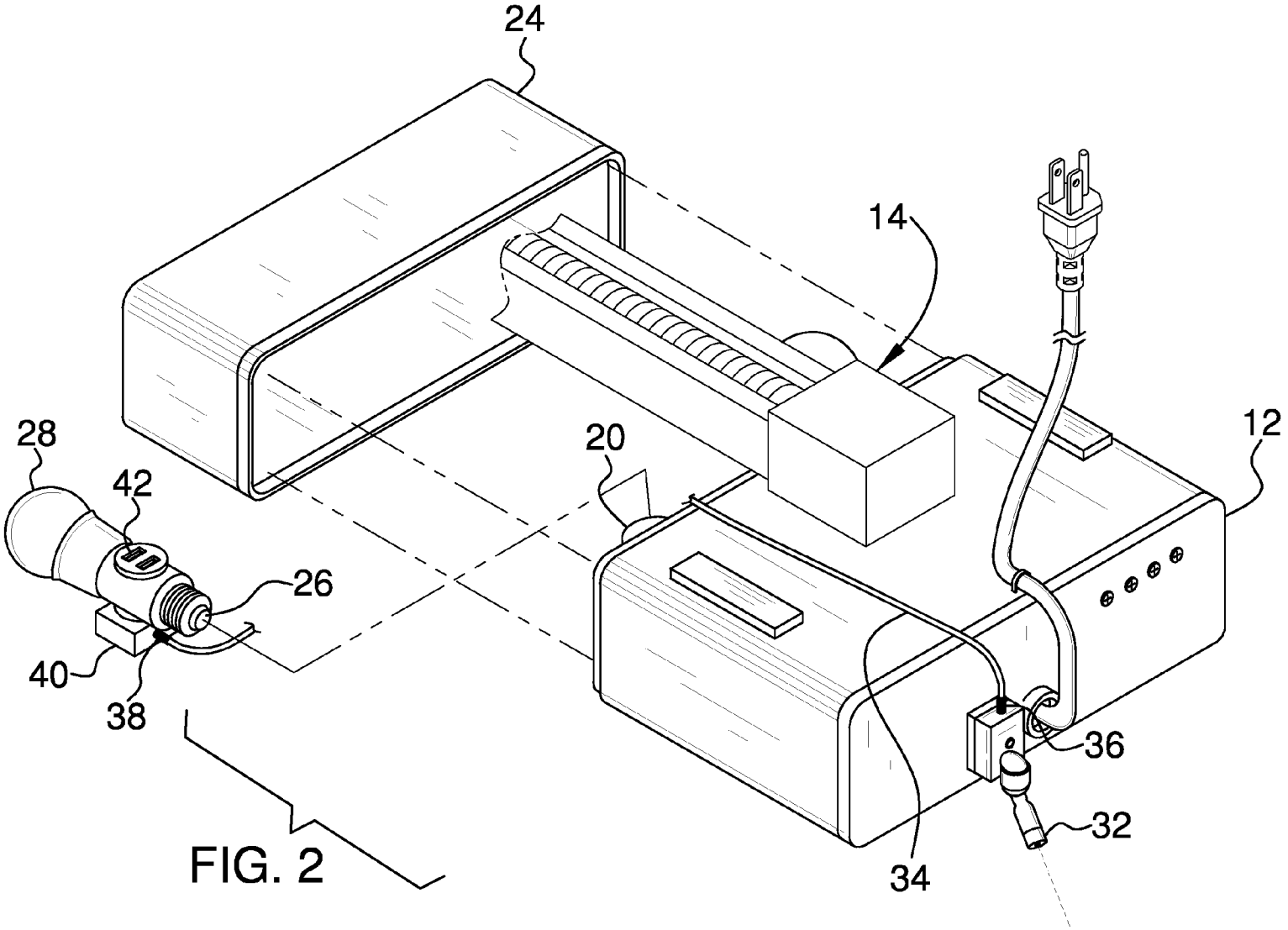
FIG. 2 is an exploded perspective view of the present invention.
Figure 3:
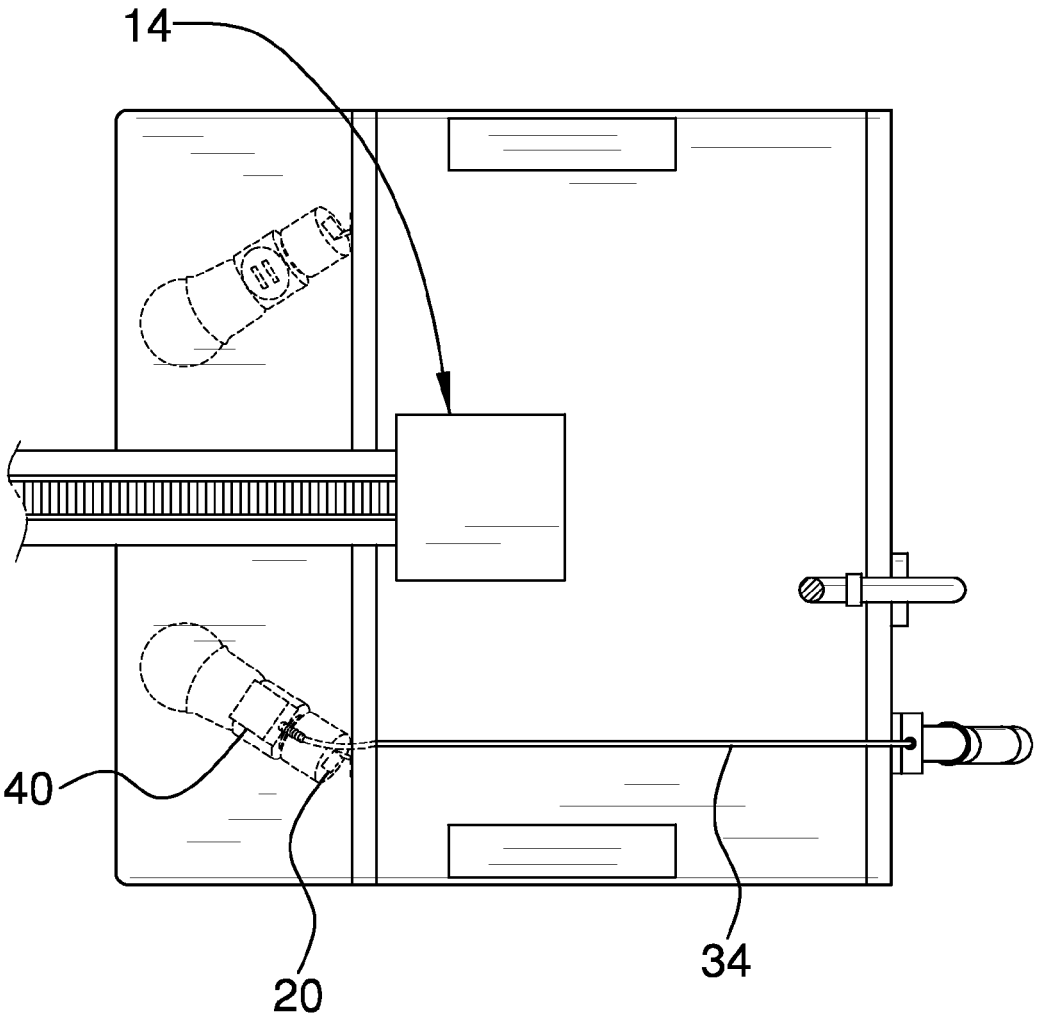
FIG. 3 is a top view of an embodiment the present invention.
Figure 4:
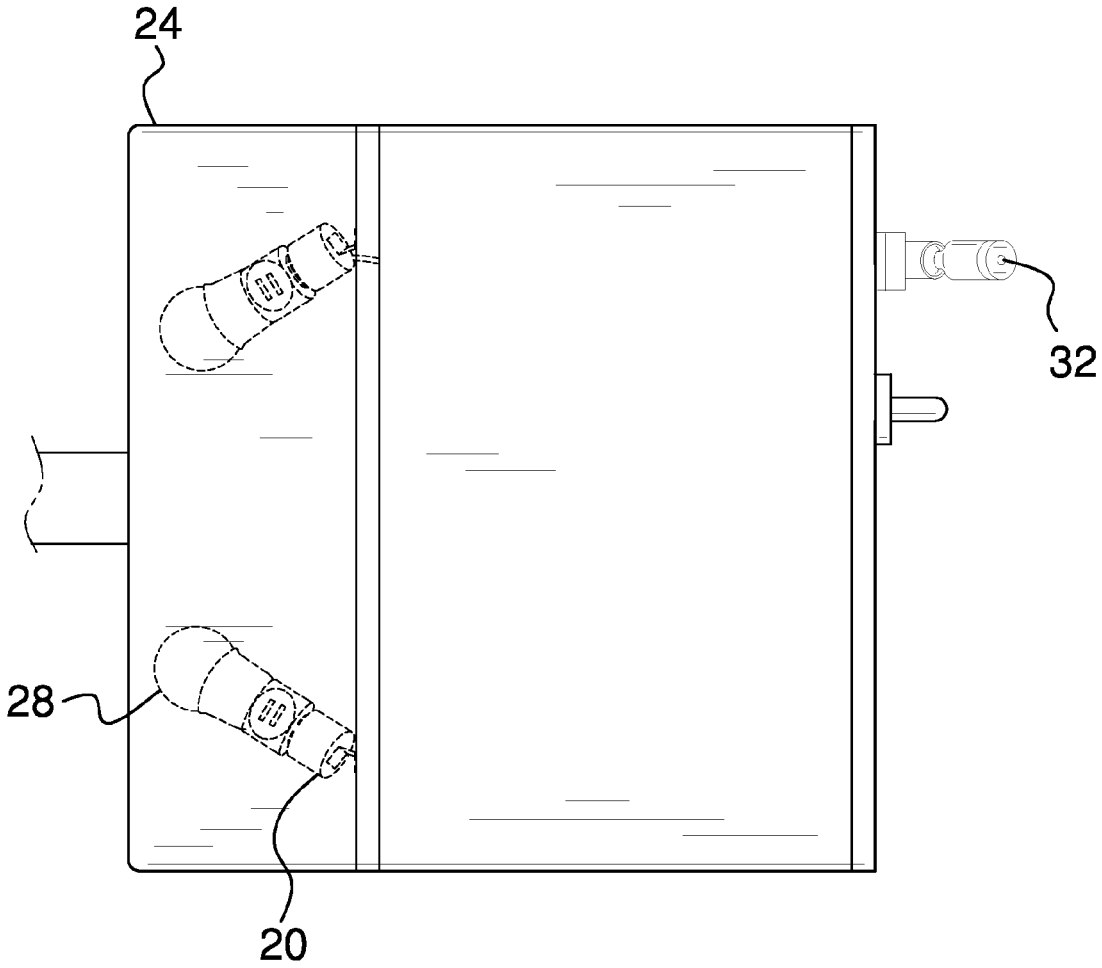
FIG. 4 is a bottom view of an embodiment of the present invention.
Figure 5:
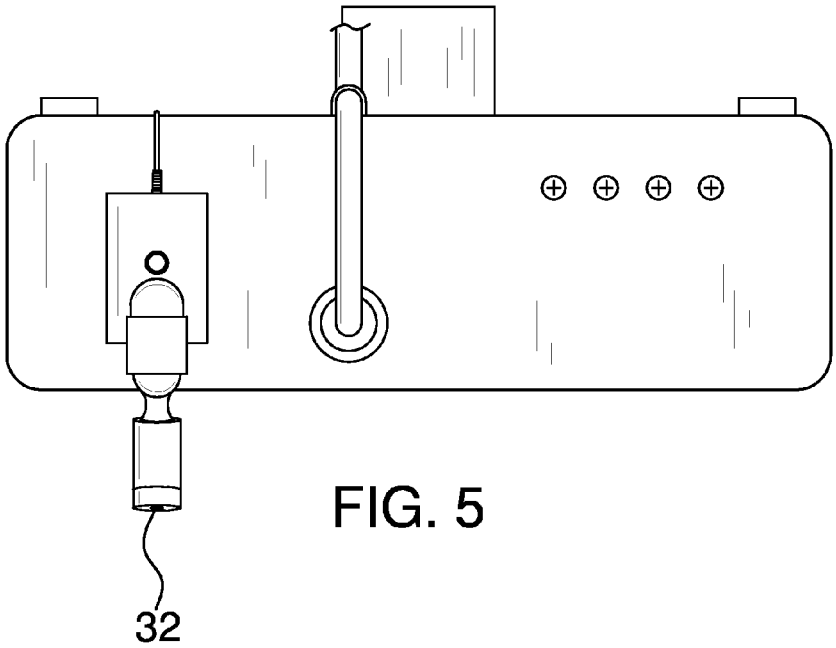
FIG. 5 is a front view of an embodiment of the present invention.
Figure 9:
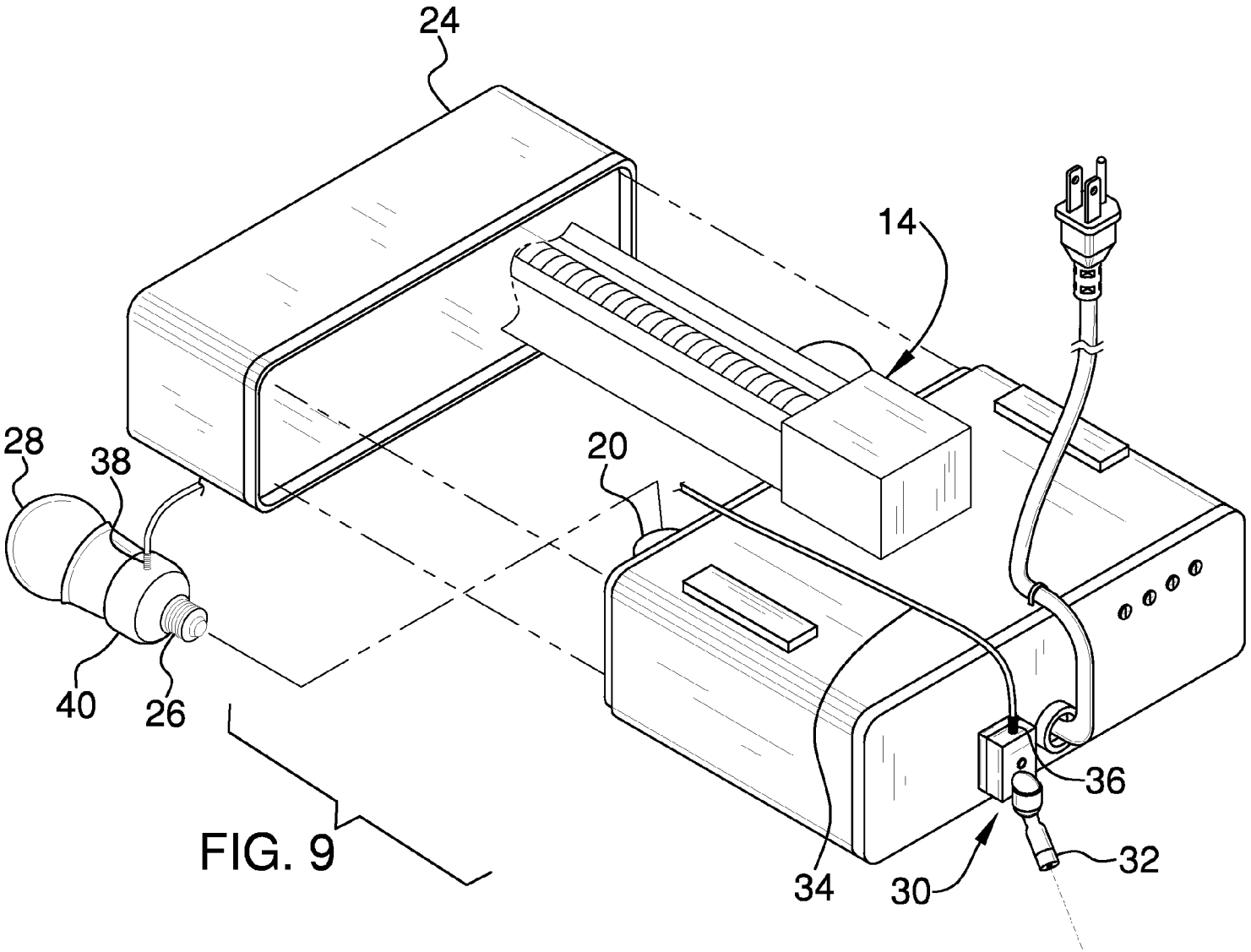
FIG. 9 is an exploded perspective view of a fourth embodiment of the present invention.
Figure 10:
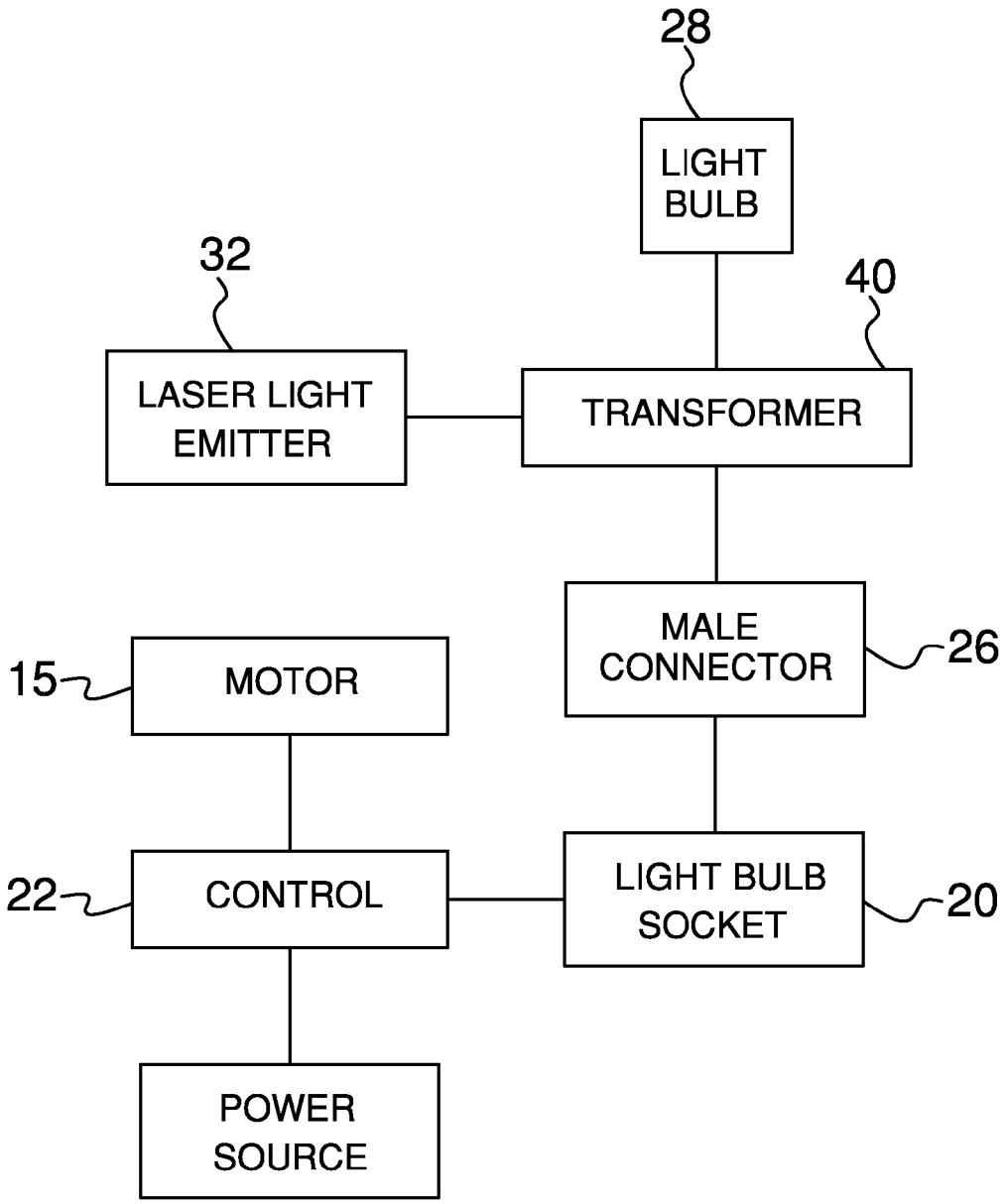
FIG. 10 is a schematic view of the present invention.

A laser light assembly 30 is electrically coupled to the male connector 26 and emits laser light when the male connector 26 receives electricity from the light bulb socket 20. The laser light assembly 30 includes a laser light emitter 32 directed to emit light to indicate a point to where a vehicle 8 should pull forward in the garage. The laser light emitter 32 is mounted on the housing 12 and is directed downward to strike a dashboard 9 of the vehicle 8 when the vehicle 8 is properly positioned within the garage. The laser light emitter may be mounted on the housing 12 with a magnet 52 which defines a base for the laser light emitter 32. The laser light emitter is rotatably or pivotally coupled to the housing 12 to facilitate directing laser light emitted by the laser light emitter 32. An electrical cable 34 has a first end 36 and a second end 38. The first end 36 is electrically coupled to the laser light emitter 32. A transformer 40 is electrically coupled to the second end 38 of the electrical cable 34. The transformer 40 is in electrical communication with the male connector 26. This may be accomplished by different structures. FIG. 2 shows a conventional light bulb 28 coupled to a power socket adapter 42 which includes the male connector 26 and the transformer 40 electrically coupled to the power socket adapter 42. FIG. 9 shows an embodiment including a light bulb 28 coupled to an integrated transformer 40 and male connector 26. In the embodiment of FIG. 1, the transformer 40 is removable from the male connector 26.

Figure 6:
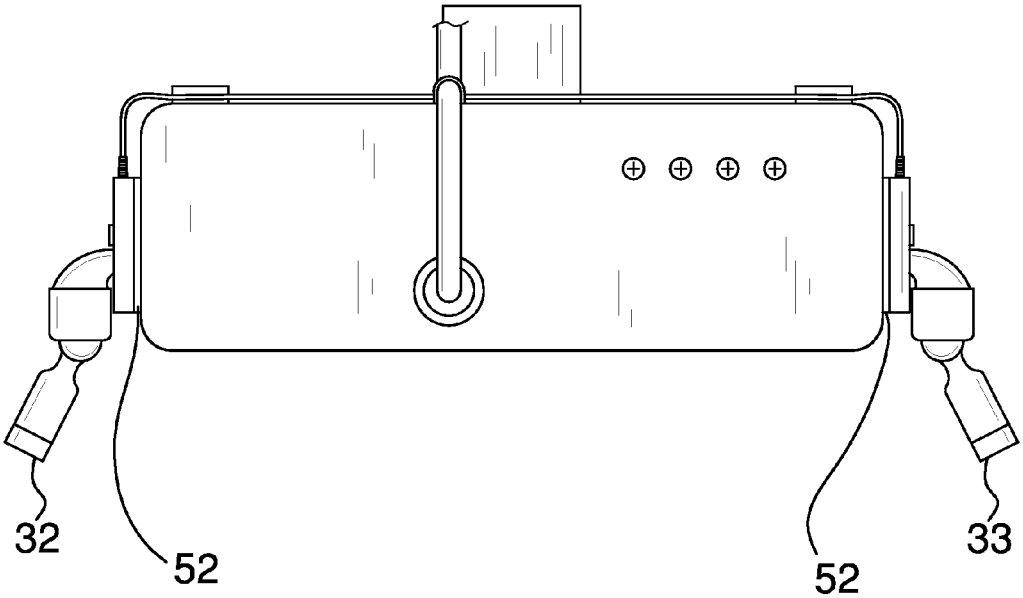
FIG. 6 is a front view of an embodiment of the present invention.
Figure 7:
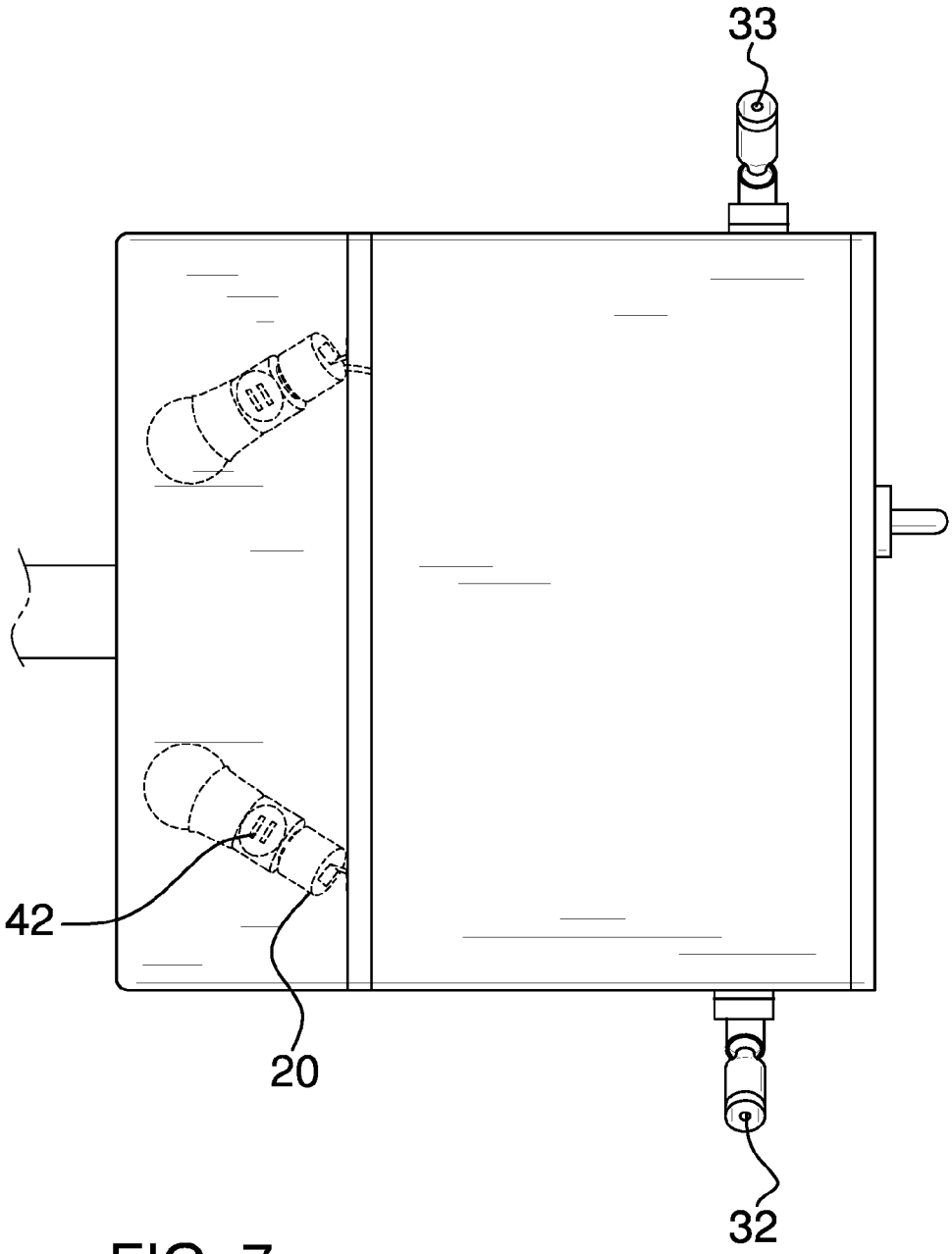
FIG. 7 is a bottom view of an embodiment of the present invention.
Figure 8:
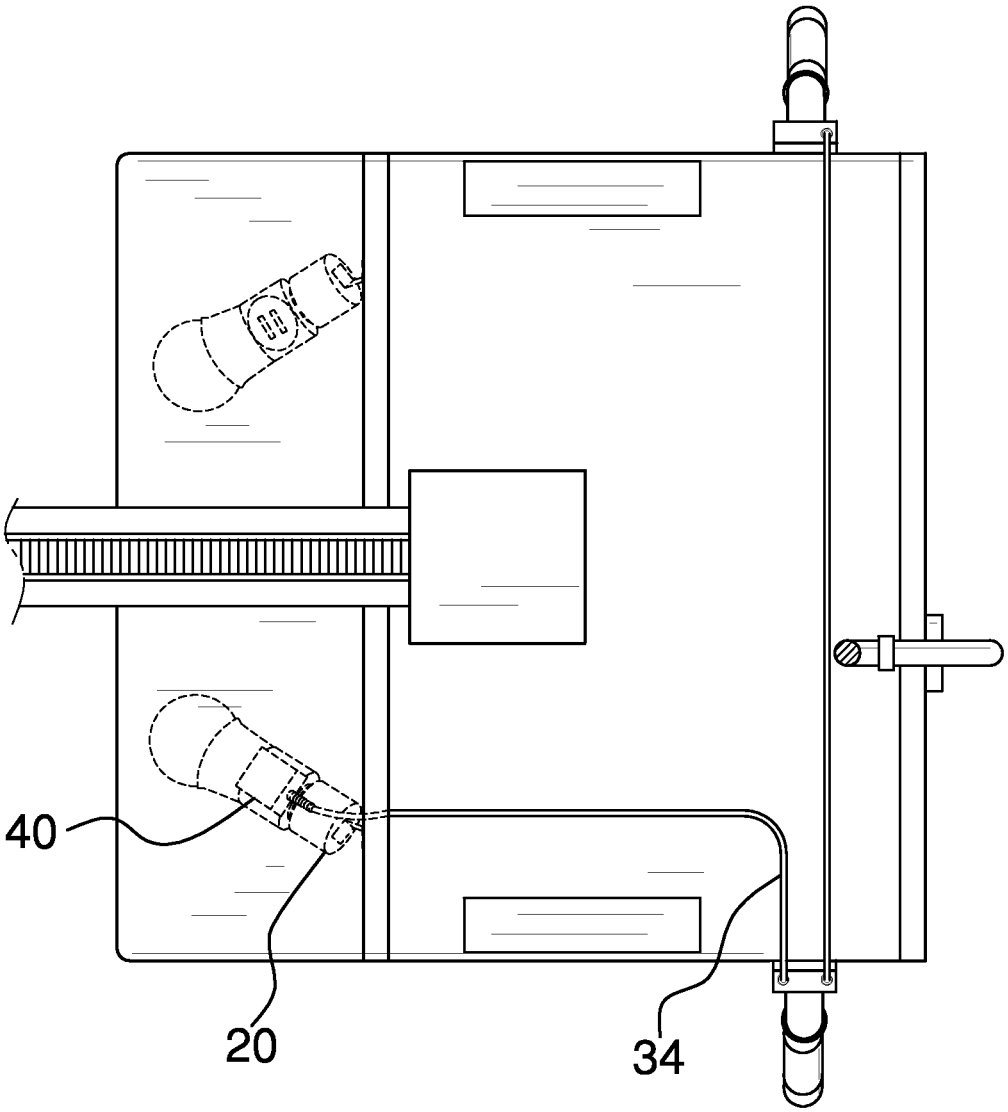
FIG. 8 is a top view of an embodiment of the present invention.

An embodiment found in FIGS. 6-8 and includes the electrical cable 34 being electrically coupled to a pair of laser light emitters 32, 33. Each of the laser light emitters 32, 33 are mounted to the housing 12 by magnets 52, and may be positioned on opposite sides of the housing 12, and each will be directed for a different vehicle 8 so that the combination 10 may be used for a double stall garage having a single garage door 16 and garage door opener.

Figure 11:
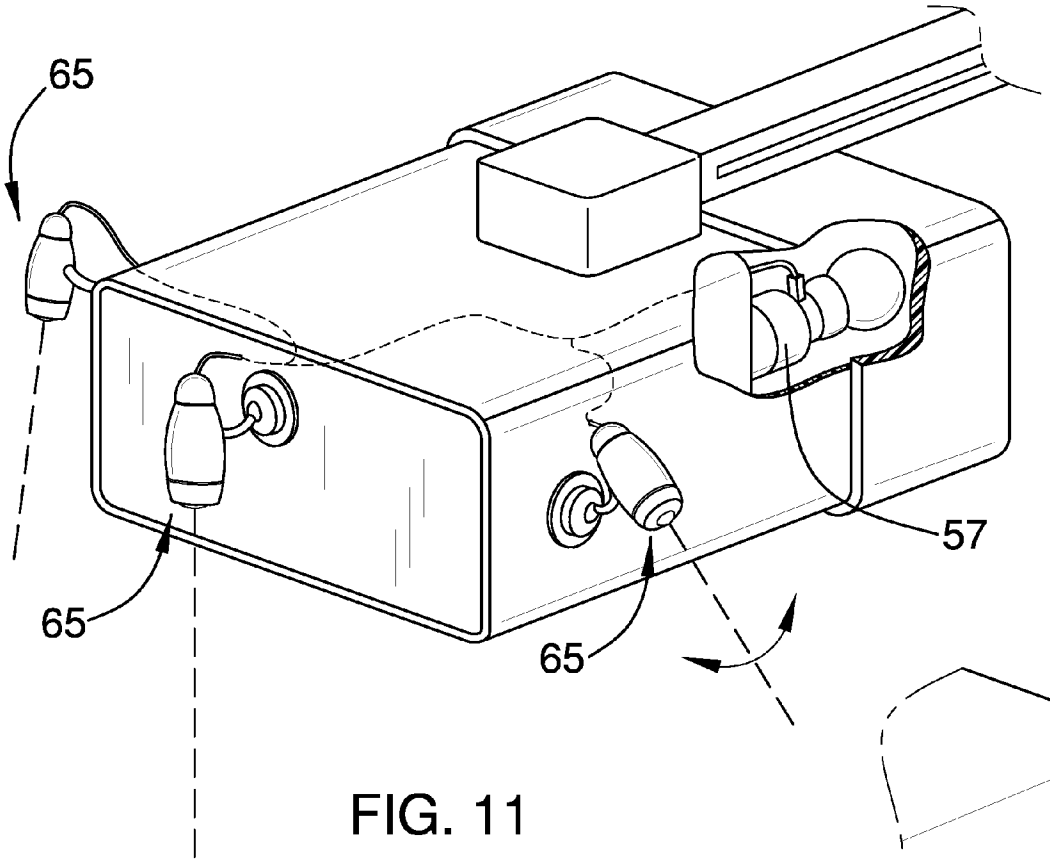
FIG. 11 is a broken, top perspective view of an embodiment of the present invention.
Figure 12:
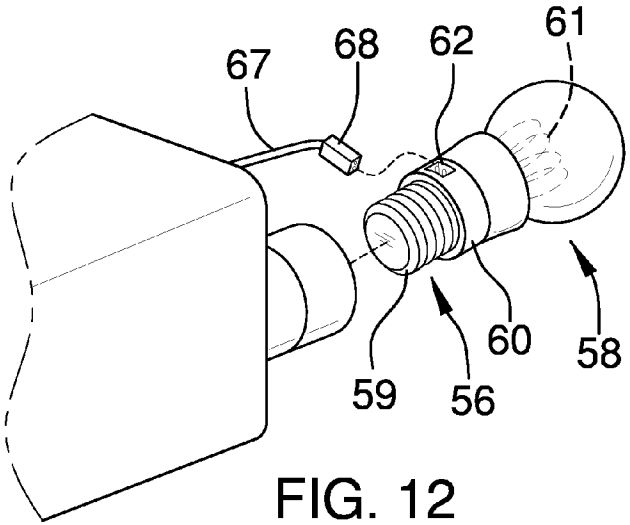
FIG. 12 a perspective view of the embodiment of the present invention shown in FIG. 11.
Figure 13:
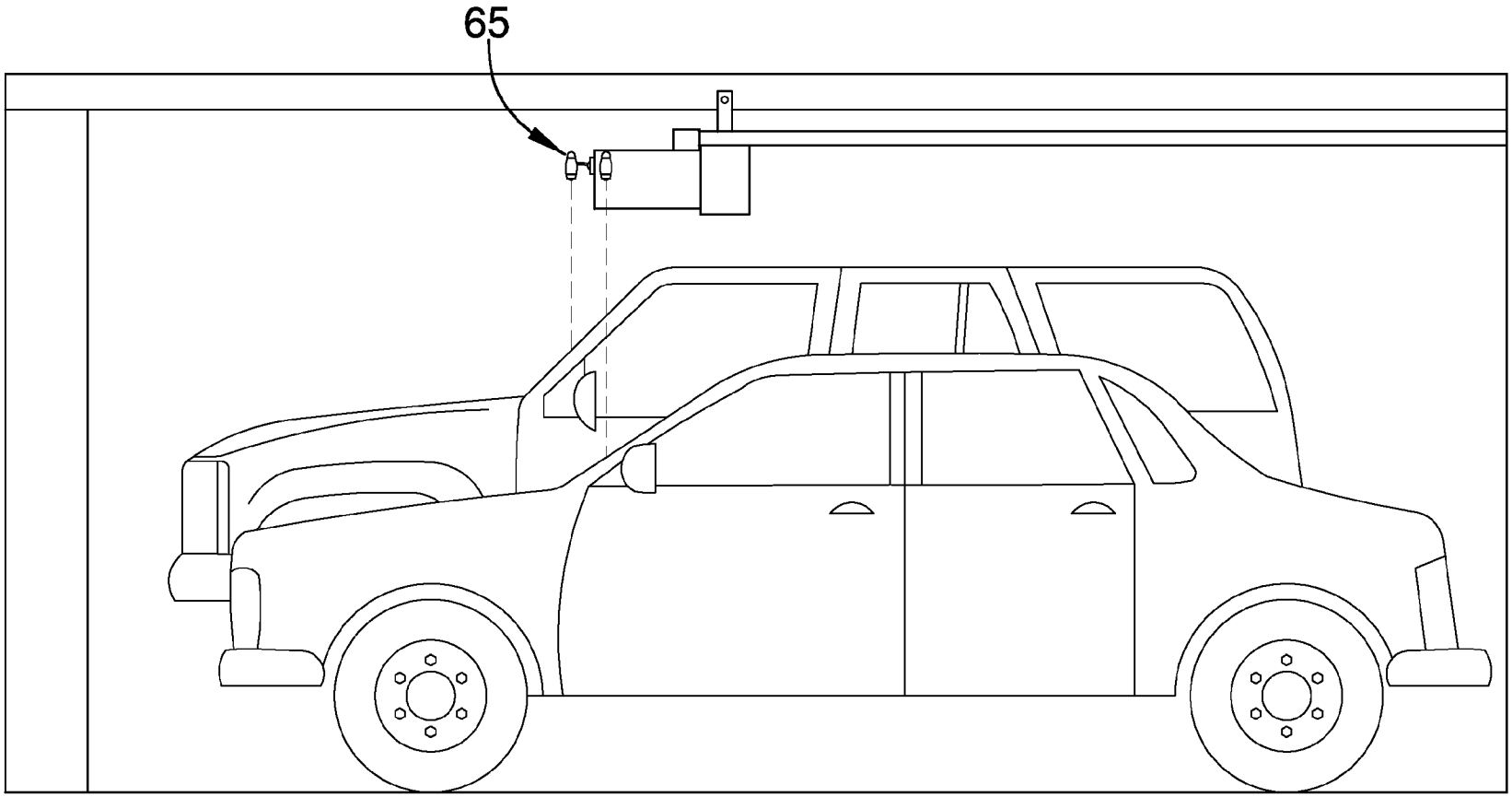
FIG. 13 a side in-use view of the embodiment of the present invention shown in FIG. 11.
Figure 14:
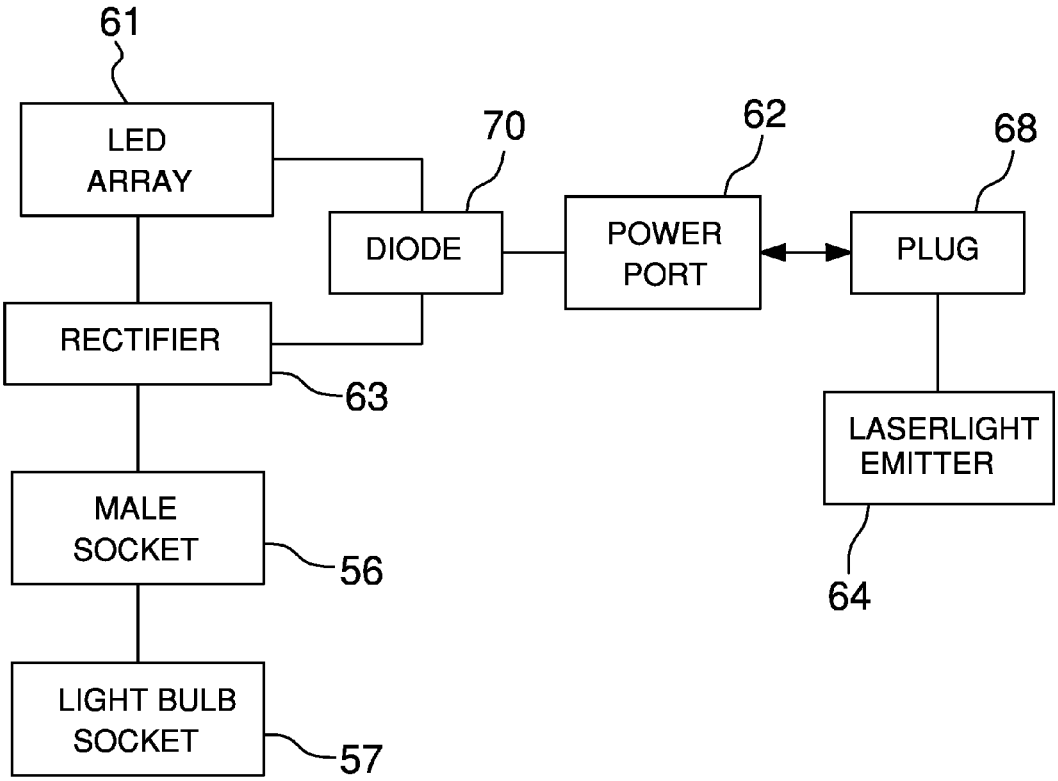
FIG. 14 is a schematic view of the embodiment of the present invention as shown in FIG. 11.

An embodiment shown in FIGS. 11-13 allows a user to selective use different lasers lights. This embodiment includes a male connector 56 configured to be removably extended into and electrically coupled to the light bulb socket 57. A light bulb 58 is electrically coupled to the male connector 56 and emits light when electricity is supplied to the light bulb socket 57. The light bulb 58 is non-removably coupled to the male connector 56. Further, the male connector 56 includes a first portion 59 and a second portion 60 wherein the second portion 60. The first portion 59 is threaded for engaging and being electrically coupled to the light bulb socket 57. The light bulb 58 includes a plurality of light emitting diodes 61 and therefore it should be understood that the term light bulb is being used to indicate light emitters which can be used for replacing of conventional incandescent lights. A first electrical coupler 62 is mounted in and non-removably affixed to the second portion 60 of the male connector 56. The first electrical coupler 62 is in electrical communication with the male connector 56 so that the first electrical coupler 62 may be used as a power port. The light bulb 58 may include a rectifier 63 for supplying direct current to the light emitting diodes 61. A diode 70 may be electrically coupled to the first electrical coupler 62 and the rectifier 63 to provide a more consistent voltage to a laser light emitter 64 and in particular to provide 5.1 volts.

A laser light assembly 65 is removably electrically coupled to the first electrical coupler 62 and emits laser light when the male connector 56 receives electricity from the light bulb socket 57. The laser light assembly 65 of this embodiment includes an electrical cable 67 having a first end and a second end. The first end comprises a second electrical coupler 68, or plug, that is removably electrically engaged to the first electrical coupler 62. The second end is electrically coupled to the laser light emitter 64. As can be seen from FIG. 11, the electrical cable 67 may be electrically coupled to a plurality of laser light emitters 64. The laser light assembly 65 includes a base 79 that may be comprised of a magnetic material to allow it to be removable coupled to a housing 12 of a garage door opener where required.

In use, a person connects the transformer 40 to the light bulb socket 20 as explained above and shown in the figures. When a user of the combination 10 opens the garage door 16, the light bulb socket 20 will power the laser light emitter 32. The user will know when to stop driving forward with the vehicle 8 into the garage when the laser light emitter 32 strikes a particular portion of the vehicle 8, such as the dashboard 9.

When the light bulb socket 20 no longer powers on the light bulb 28, the laser light emitter 32 is also turned off. The cable 34 allows the user to place the laser light emitter 32 where they choose on an outer surface of the housing 12. A reflective panel 50 may be placed on the dashboard 9 to act as a target for the laser light emitter 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage door opener and parking guide combination comprising:

a housing including a drive assembly mechanically coupled to a garage door to selectively open or close the garage door when said drive assembly is activated, said housing being attached to a ceiling of a garage containing the garage door, a light bulb socket being in electrical communication with a control of said drive assembly and receiving electricity while said drive assembly is activated and for a pre-selected time thereafter;

a translucent covering being removably attached to said housing and positioned over said light bulb socket;

a male connector being removably extended in and electrically coupled to said light bulb socket, a light bulb being electrically coupled to said male connector and emitting light when electricity is supplied to said light bulb socket, said light bulb being non-removably coupled to said male connector, said male connector including a first portion and a second portion, said second portion, said first portion being threaded;

said light bulb including a plurality of light emitting diodes;

a first electrical coupler being mounted in and non-removably affixed to said second portion of said male connector, said first electrical coupler being in electrical communication with said male connector;

a laser light assembly being removably electrically coupled to said first electrical coupler and emitting laser light when said male connector receives electricity from said light bulb socket.

2. The combination according to claim 1, wherein laser light assembly includes a laser light emitter directed to emit light to indicate a point to where a vehicle should pull forward in the garage.

3. The combination according to claim 1, wherein laser light assembly includes said laser light emitter being rotatably mounted on said housing and being directed downward to strike a dashboard of the vehicle when the vehicle is properly positioned within the garage.

4. The combination according to claim 1, wherein laser light assembly includes an electrical cable having a first end and a second end, said first end comprising a second electrical coupler being removably electrically engaged to said first electrical coupler, said second end being electrically coupled to said laser light emitter.

5. A garage door opener and parking guide combination comprising:

a housing including a drive assembly mechanically coupled to a garage door to selectively open or close the garage door when said drive assembly is activated, said housing being attached to a ceiling of a garage containing the garage door, a light bulb socket being in electrical communication with a control of said drive assembly and receiving electricity while said drive assembly is activated and for a pre-selected time thereafter;

a translucent covering being removably attached to said housing and positioned over said light bulb socket;

a male connector being removably extended in and electrically coupled to said light bulb socket, a light bulb being electrically coupled to said male connector and emitting light when electricity is supplied to said light bulb socket, said light bulb being non-removably coupled to said male connector, said male connector including a first portion and a second portion, said first portion being threaded;

said light bulb including a plurality of light emitting diodes;

a first electrical coupler being mounted in and non-removably affixed to said second portion of said male connector, said first electrical coupler being in electrical communication with said male connector;

a laser light assembly being electrically coupled to said male connector and emitting laser light when said male connector receives electricity from said light bulb socket, said laser light assembly including;

a laser light emitter directed to emit light to indicate a point to where a vehicle should pull forward in the garage, said laser light emitter being rotatably mounted on said housing and being directed downward to strike a dashboard of the vehicle when the vehicle is properly positioned within the garage; and an electrical cable having a first end and a second end, said first end comprising a second electrical coupler being removably electrically engaged to said first electrical coupler, said second end being electrically coupled to said laser light emitter.

6. A parking guide assembly configured to be mechanically coupled to a light bulb socket of a garage door opener, said assembly including:

a male connector being configured to be removably extended into and electrically coupled to the light bulb socket, a light bulb being electrically coupled to said male connector and emitting light when electricity is supplied to the light bulb socket, said light bulb being non-removably coupled to said male connector, said male connector including a first portion and a second portion, said first portion being threaded;

said light bulb including a plurality of light emitting diodes;

a first electrical coupler being mounted in and non-removably affixed to said second portion of said male connector, said first electrical coupler being in electrical communication with said male connector; and a laser light assembly being removably electrically coupled to said first electrical coupler and emitting laser light when said male connector receives electricity from said light bulb socket.

7. The assembly according to claim 6, wherein laser light assembly includes a laser light emitter directed to emit light to indicate a point to where a vehicle should pull forward in a garage.

8. The assembly according to claim 6, wherein laser light assembly includes a base being attached to said laser light emitter, said base being configured to be attached to a housing of the garage door opener, said laser light emitter being rotatable with respect to said base, said second end being electrically coupled to said laser light emitter.

9. The assembly according to claim 8, wherein laser light assembly includes an electrical cable having a first end and a second end, said first end comprising a second electrical coupler being removably electrically engaged to said first electrical coupler.

10. The assembly according to claim 6, wherein laser light assembly includes an electrical cable having a first end and a second end, said first end comprising a second electrical coupler being removably electrically engaged to said first electrical coupler, said second end being electrically coupled to said laser light emitter.

11. The assembly according to claim 8, wherein said base comprises a magnet.

12. The assembly according to claim 9, wherein said base comprises a magnet.

* * * * *